US012638254B2

(12) United States Patent
Puchala et al.

(10) Patent No.: US 12,638,254 B2
(45) Date of Patent: May 26, 2026

(54) MANIFOLD ALIGNMENT FOR A COLD PLATE COOLING SYSTEM

(71) Applicant: Aptiv Technologies AG, Schaffhausen (CH)

(72) Inventors: Grzegorz Puchala, Cracow (PL); Jakub Zborowski, Cracow (PL); Lukasz Stanek, Cracow (PL); Waldemar Wodecki, Cracow (PL); Jakub Korta, Cracow (PL); Tomasz Dolot, Cracow (PL); Michal Wisniowski, Libiaz (PL); Marcin Pietras, Cracow (PL)

(73) Assignee: Aptiv Technologies AG, Schaffhausen (CH)

( * ) Notice: Subject to any disclaimer, the term of this patent is extended or adjusted under 35 U.S.C. 154(b) by 130 days.

(21) Appl. No.: 18/434,100

(22) Filed: Feb. 6, 2024

(65) Prior Publication Data

US 2024/0263892 A1 Aug. 8, 2024

(30) Foreign Application Priority Data

Feb. 8, 2023 (EP) ..... 23155659

(51) Int. Cl.
*F28F 9/02* (2006.01)
*F28F 3/12* (2006.01)

(52) U.S. Cl.
CPC . *F28F 9/02* (2013.01); *F28F 3/12* (2013.01)

(58) Field of Classification Search
CPC ... F28D 9/00; F28D 9/005; F28D 9/02; F28D 9/0246; F28D 9/027; F28F 3/12; F28F 9/0256
See application file for complete search history.

(56) References Cited

U.S. PATENT DOCUMENTS 5,649,361 A * 7/1997 Hindle ..... F28F 9/0256 29/890.047
2015/0233650 A1* 8/2015 Blomgren ..... F28F 3/06 165/166
2017/0082376 A1* 3/2017 Blanchard ..... F28D 9/0006
2022/0338374 A1 10/2022 Heydari

FOREIGN PATENT DOCUMENTS

DE 102015208988 A1 * 11/2016 ..... F28F 9/0246

OTHER PUBLICATIONS

Extended European Search Report for EP 23155659.8, 11 pages Jul. 6, 2023.

* cited by examiner

*Primary Examiner* — Harry E Arant
(74) *Attorney, Agent, or Firm* — Miller Johnson

(57) ABSTRACT

A coolant fluid manifold assembly for coupling to multiple cold plates includes a first manifold portion including a first positioning member. The manifold assembly includes a second manifold portion including a second positioning member. The second manifold portion is configured to couple to the first manifold portion. The second positioning member is configured to engage the first positioning member to correctly position the first and second manifold portions.

15 Claims, 8 Drawing Sheets

MANIFOLD ALIGNMENT FOR A COLD PLATE COOLING SYSTEM

CROSS-REFERENCE TO RELATED APPLICATIONS

This application claims priority to EP 23 155 659 filed Feb. 8, 2023, the entire disclosure of which is incorporated by reference.

FIELD

The present disclosure relates to cold plate cooling systems and, in particular, to coolant fluid manifolds for use in a cold plate cooling system.

BACKGROUND

Cold plate cooling systems are typically used to actively cool electronic components or electronic devices, for example within a vehicle.

The electronic systems within an automotive vehicle are becoming increasingly numerous and complex, with vehicles often being equipped with multiple electronic systems to control various vehicle functionalities. Accordingly, domain control units (DCUs) are becoming more common, as the DCU controls a set of vehicle functions related to a specific area or domain. These systems (such as a DCU) include a high number of electronics which require cooling in order to function optimally. Liquid cooling with heat exchangers, where coolant flow absorbs heat from the electronics and transfers the heat away, is one of the most effective cooling systems for electronics.

An example of a heat exchanger design that can be used in cooperation with liquid cooling systems is a plate heat exchanger. This is referred to in the present disclosure as a cold plate cooling system.

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

There is a need to ensure accurate spacing and alignment between adjacent cold plates to ensure the cooling system operates correctly and efficiently.

Aspects of the present disclosure are set out in the accompanying independent and dependent claims. Combinations of features from the dependent claims may be combined with features of the independent claims as appropriate and not merely as explicitly set out in the claims.

According to a first aspect of the present disclosure, there is provided a coolant fluid manifold assembly for coupling to a plurality of cold plates, wherein the manifold assembly comprises a first manifold portion comprising a first positioning member, and a second manifold portion comprising a second positioning member, wherein the second manifold portion is configured to couple to the first manifold portion and the second positioning member is configured to engage the first positioning member to correctly position the first and second manifold portions.

The positioning members advantageously ensure that the first manifold and the second manifold are assembled correctly such that the cold plates that are coupled to the manifold assembly during use are located at the correct position, and have the desired orientation and separation distance.

The first and second positioning members may be external features, or provided on an external surface of the respective manifold portion. Thus, the positioning members can be seen when the first and second manifold portions are coupled together.

Optionally, a portion of the first positioning member is configured to be aligned with a portion of the second positioning member.

Optionally, each positioning member may comprise a visual indicator, wherein the visual indicator of the first positioning member is configured to be aligned with the visual indicator of the second positioning member to correctly position the first and second manifold portions. Thus, this can provide a visual indication to the user that the first and second manifolds are in the correct position.

Optionally, each positioning member comprises a respective aperture for receiving a fastener. The aperture may be considered to be a visual indicator. The aperture of the first positioning member may be configured to be aligned with the aperture of the second positioning member when the first and second manifold portions are correctly positioned.

Optionally, each aperture may be a through-hole. Optionally, only one of the apertures may be a through-hole. In some embodiments, at least one of the apertures may be provided in a boss, or a screw boss.

Optionally, at least one aperture may be threaded.

Optionally, each positioning member comprises a respective flat engagement surface. The engagement surface of the first positioning member is therefore configured to contact the engagement surface of the second positioning member.

In some embodiments, the flat engagement surfaces may be configured to be clamped together. Thus, the engagement surface may be referred to as a clamping surface.

The aperture for receiving a fastener may be provided in the flat engagement surface.

Optionally, each positioning member comprises a pair of wings, arms, protrusions or projections. It will be appreciated that these terms may be used interchangeably in this disclosure.

Optionally, the first manifold portion comprises a first pipe and the second manifold portion comprises a first receiving portion. The first receiving portion may be an opening or aperture.

An end of the first pipe may be configured to be inserted into the first receiving portion to form an interface between the first manifold portion and the second manifold portion. Thus, a fluid flow path may extend through the first pipe and the first receiving portion.

Optionally, the first positioning member is adjacent or proximate the end of the first pipe. Optionally, the second positioning member is adjacent or proximate the first receiving portion. Thus, when the manifold is assembled, the first and second positioning members may be adjacent the interface between the first pipe and the first receiving portion.

Optionally, the first positioning member comprises a threaded screw boss. The threaded screw boss may have a through-hole.

Optionally, the end of the first pipe comprises an annular groove for receiving an O-ring. The O-ring may be configured to be positioned at the internal interface between the first pipe and the first receiving portion. The O-ring may be configured to provide a seal, or a fluid-tight seal, between the first pipe and the first receiving portion.

Optionally, the first positioning member comprises a pair of projections extending either side of the first pipe. The second positioning member may comprise a pair of projections extending either side of the first receiving portion.

The projections may extend in opposite directions either side of the corresponding pipe or receiving portion.

Optionally, the first positioning member comprises at least one pair of apertures for receiving a respective fastener. The apertures may be located on either side of the first pipe. Thus, each projection of the first positioning member may comprise an aperture for receiving a respective fastener.

Optionally, the second positioning member comprises at least one pair of apertures for receiving a respective fastener. The apertures may be located on either side of the first receiving portion. Thus, each projection of the second positioning member may comprise an aperture for receiving a respective fastener.

Optionally, the first manifold portion further comprises a second receiving portion. The second manifold portion may comprise a second pipe. An end of the second pipe may be configured to be inserted into the second receiving portion.

Thus, a second internal interface may be formed between the first manifold portion and the second manifold portion.

Each pipe and each receiving portion may comprise a respective positioning member, as defined above.

Thus, when assembled, a first fluid flow path may extend through the first pipe and the first receiving portion, and a second fluid flow path may extend through the second pipe and the second receiving portion.

In some embodiments, the first pipe may be an inlet pipe and the second pipe may be an outlet pipe, or vice versa.

Each pipe may comprise a respective positioning member as defined above.

In some embodiments, only the first pipe and the first receiving portion each comprise a respective positioning member.

Optionally, the first pipe may be integral to the first manifold portion and/or the second pipe may be integral to the second manifold portion. The first manifold portion, including the first pipe and the second receiving portion, may be a unitary structure. The second manifold portion, including the second pipe and the first receiving portion, may be a unitary structure.

Thus, a further advantage of the manifold assembly of this disclosure is that it may be more compact and space-efficient than existing manifold assemblies. This is particularly beneficial in applications where space is at a premium, such as in the automotive industry, where saving space can provide a significant cost saving.

Optionally, the first positioning member is integral to the first manifold portion and/or the second positioning member is integral to the second manifold portion. Accordingly, in some embodiments each positioning member is integrated with the respective manifold portion, rather than being removably connected or coupled to the respective manifold portion.

Optionally, the first manifold portion and/or the second manifold portion may be die cast. Optionally, the first manifold portion and/or the second manifold portion may be formed of die cast metal. Optionally, the metal may be aluminum.

In some embodiments, the first manifold portion, including the first positioning member, may be a unitary structure. In some embodiments, the second manifold portion, including the second positioning member, may be a unitary structure.

Optionally, each unitary structure may be die cast.

According to a second aspect of the present disclosure, there is provided a cooling system comprising the manifold assembly according to any embodiment or example of the first aspect of this disclosure, a first cold plate coupled to the first manifold portion and a second cold plate coupled to the second manifold portion.

As defined above, the first positioning member is engaged with the second positioning member to position the manifold portions and the cold plates in the correct position and orientations. Thus, the positioning members advantageously provide control over the location, alignment and orientation of the first and second cold plates.

The first cold plate and the second cold plate may be arranged in a stack, wherein a gap is provided between the first and second cold plates.

Optionally, each manifold portion comprises an inlet channel and an outlet channel. Each cold plate may comprise an inlet passage and an outlet passage, each passage extending longitudinally through a body of the cold plate.

Optionally, the inlet passage of each cold plate is interfaced with the respective inlet channel, and the outlet passage of each cold plate is interfaced with the respective outlet channel of the respective manifold portion.

However, it will be appreciated that any type of cold plate may be used with the manifold assembly of the present disclosure. The cold plate may comprise a plurality of inlet passages and/or a plurality of outlet passages.

Optionally, the cooling system may comprise a first return manifold coupled to the first cold plate and a second return manifold coupled to the second cold plate.

Each return manifold may be coupled to the inlet passage and the outlet passage of the respective cold plate.

As defined above, each positioning member may optionally comprise a pair of projections that extend either side of a pipe or receiving portion of the respective manifold portion. Each projection may extend in a direction parallel to a plane defined by the respective cold plate.

Optionally, each positioning member may comprise a flat engagement surface. The engagement surface of the first positioning member may be clamped to the engagement surface of the second positioning member. When clamped, the engagement surfaces may be parallel to the first and second cold plates. More specifically, the engagement surfaces may be parallel to a plane defined by the cold plate.

According to a third aspect of this disclosure, there is provided a method of assembling a cooling system, comprising coupling a first manifold portion to a first cold plate, the first manifold portion comprising a first positioning member, coupling a second manifold portion to a second cold plate, the second manifold portion comprising a second positioning member, and coupling the second manifold portion to the first manifold portion such that the first positioning member engages the second positioning member to locate the first and second cold plates at the correct positions and orientations.

Optionally, the method further comprises securing or fixing the first positioning member to the second positioning member, to retain the first and second manifold portions in the correct position. The securing may comprise welding, brazing, or fastening the first positioning member to the second positioning member.

Optionally, the method further comprises clamping a flat engagement surface of the first positioning member to a flat engagement surface of the second positioning member.

The flat engagement surfaces may be parallel to the respective cold plate.

Optionally, each positioning member comprises a respective aperture for receiving a fastener, and the method further comprises securing the first and second manifold portions together by inserting a fastener through the aperture in each positioning member.

Optionally, each aperture may be a through-hole. Optionally, only one of the apertures may be a through-hole. In some embodiments, at least one of the apertures may be provided in a boss, or a screw boss.

Optionally, the fastener may be a screw, or a bolt.

Optionally, the first manifold portion comprises a first pipe. An end of the first pipe may comprise an annular groove. Optionally, the second manifold portion comprises a first receiving portion.

The method may further comprise seating or inserting an O-ring in the annular groove.

Coupling the second manifold portion to the first manifold portion may comprise inserting the end of the first pipe into the first receiving portion. The O-ring may be located at the interface between the first pipe and the first receiving portion.

Thus, an internal interface or engagement may be provided between the first and second manifold portions, and an external interface or engagement may be provided by the engagement between the first and second positioning members.

It will be appreciated that the manifold assembly may be as defined in any embodiment or example of the first aspect of this disclosure.

The method may be a method of assembling any embodiment of the cooling system as defined in the second aspect of this disclosure Further areas of applicability of the present disclosure will become apparent from the detailed description, the claims, and the drawings. The detailed description and specific examples are intended for purposes of illustration only and are not intended to limit the scope of the disclosure.

BRIEF DESCRIPTION OF THE DRAWINGS

Embodiments of this disclosure will be described hereinafter, by way of example only, with reference to the accompanying drawings in which like reference signs relate to like elements and in which.

In the drawings, reference numbers may be reused to identify similar and/or identical elements.

DETAILED DESCRIPTION

Embodiments of this disclosure are described in the following with reference to the accompanying drawings.

Figure 1:
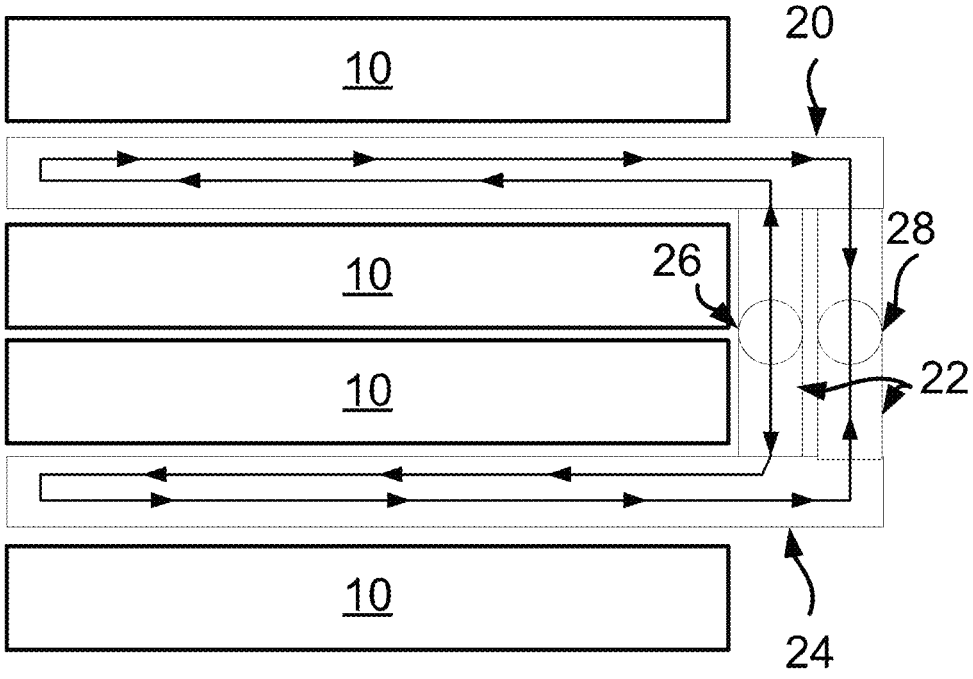
FIG. 1 is a diagram representing fluid flow in a cooling system.

FIG. 1 shows an example of fluid flow in a cooling system for cooling a plurality of electronic controllers, ECUs, 10. The cooling system comprises a first cold plate 20 and a second cold plate 24. First and second electronic controllers, ECUs, 10 are illustrated positioned between the cold plates 20, 24 such that each ECU is thermally coupled to a respective cold plate. A thermal interface material (not shown) may be applied to the ECUs, such that the thermal interface material is provided between the ECUs 10 and the cold plates 20, 24. It will be appreciated that the number of ECUs located in a rack may be varied depending on operating requirements, for example one ECU only may be provided.

At least one manifold is provided to circulate coolant fluid through internal channels in the cold plates 20, 24 to actively cool the electronic controllers 10. In the example shown in FIG. 1, the manifold 22 comprises an inlet 26 and an outlet 28. The inlet 26 is configured to receive input coolant fluid and to output the coolant fluid to the first and second cold plates 20, 24. The inflow stream of coolant fluid from the inlet 26 to the first and second cold plates 20, 24 is shown by the arrows extending from the inlet 26 in FIG. 1. The coolant fluid then returns via an outflow stream (as shown by the arrows) to the outlet 28, wherein the coolant fluid is output from the system.

This type of heat exchanger (or cooling system) is relatively compact and therefore useful in automotive design, and other types of system which are typically characterized by tight assembly spaces.

Figure 2:
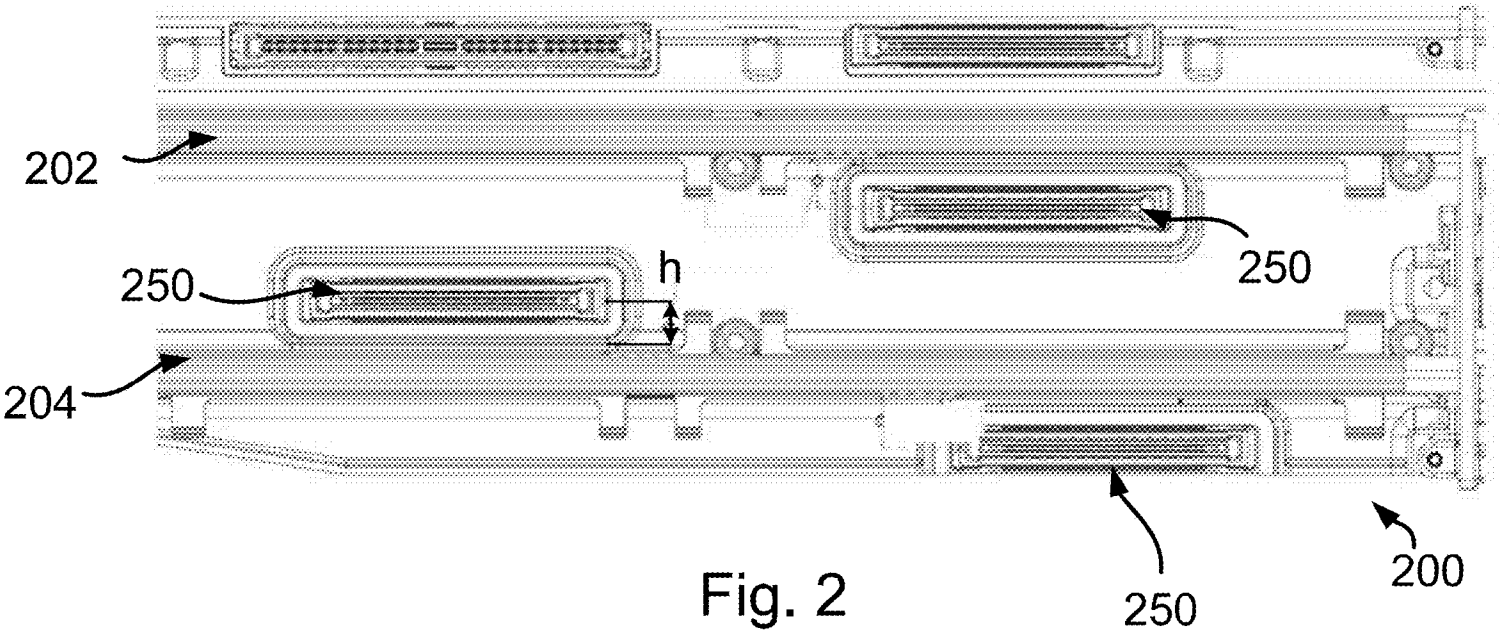
FIG. 2 shows a side view of a portion of a cooling system when inserted into a rack.
Figure 3:
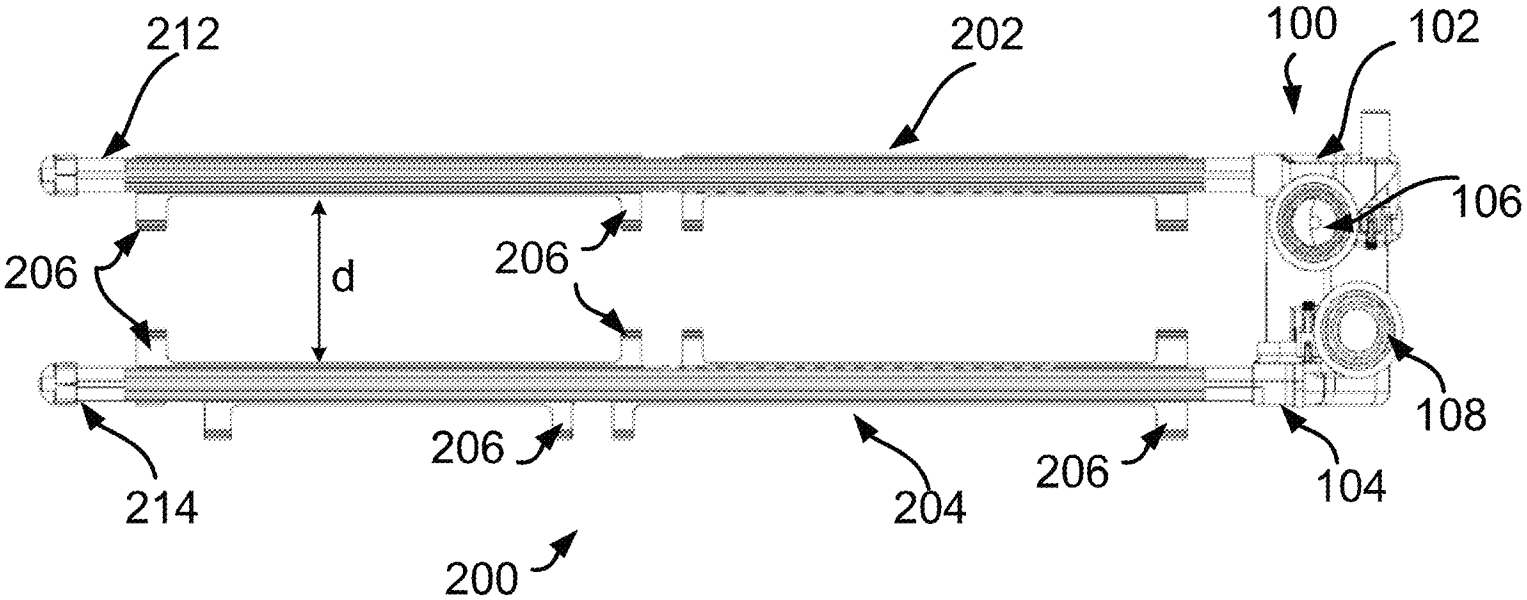
FIG. 3 shows an assembled cooling system according to an embodiment of this disclosure.

In order to ensure correct and efficient operation of the cooling system, including mating between connectors and uniform thermal interface compression, it is required to keep the cold plate separation distance (top to bottom) as accurate as possible (i.e. keep a tight tolerance on the distance) as shown in FIGS. 2 and 3. This distance is labelled as d in FIG. 3. Thus, there is a need to ensure accurate spacing and alignment between adjacent cold plates to ensure the cooling system operates correctly and efficiently.

FIG. 2 is a side view of a portion of a cooling system 200 according to an embodiment of this disclosure, wherein the cooling system 200 has been inserted to a rack. The cold plates 202, 204 comprise blade locators 206 for coupling the cold plates 202, 204 to the rack. It is important for the cold plates 202, 204 to be positioned accurately and precisely within tolerances to ensure that the cold plates mate correctly with btb connectors 250, otherwise the rack may not function correctly or optimally. Thus, the distance h between the midpoint or center of each btb connector 250 and the corresponding cold plate 202, 204 must be controlled. It will be appreciated that the specific distance h will depend on the particular application and customer requirements.

FIG. 3 is a side view of an assembled cooling system 200 according to an embodiment of this disclosure. In FIG. 3 (as in FIG. 2) the cooling system 200 comprises two cold plates 202, 204 arranged in a vertical stack. It will be appreciated that the present disclosure is not limited to any particular type of cold plate or number of cold plates, or to the cold plates shown in the accompanying figures. The cold plates 202, 204 comprises blade locators 206 for coupling the cold plate to a rack (as in FIG. 2).

The cold plates 202, 204 are coupled to a manifold assembly 100. In some embodiments, the cold plates 202, 204 may be formed by extrusion, although any suitable manufacturing process may be used. The manifold assembly 100 comprises an inlet pipe 108 for inputting a coolant fluid to each of the cold plates 202, 204 and an outlet pipe 106 for outputting the coolant fluid after it has circulated through the respective cold plate (see FIG. 1). Thus, the manifold assembly 100 provides the coolant fluid to actively cool the cold plates. It will be appreciated that pipe 106 may equally be the inlet pipe and pipe 108 may equally be the outlet pipe. Moreover, the configuration of pipes in the manifold assembly 100 is not limited to the embodiment shown in the accompanying figures.

Ideally, the cooling system 200 would be manufactured as a single unitary part, for example by a one-shot brazing process. This would ensure that all parts of the system, including the cold plates and the manifold assembly, are fixed in the correct alignment relative to each other. However, this manufacturing process is in practice not currently feasible due to a number of factors, including the flatness tolerance of cooling areas and burst pressure resistance. Instead, it is required to divide the system 200 into a number of separate component parts, that are manufactured individually.

In the specific embodiment shown in FIG. 3, the cooling system 200 is divided into the following component parts: the first cold plate 202; the second cold plate 204; a first manifold portion 102; a second manifold portion 104; a first return manifold 212 and a second return manifold 214. In other embodiments, fewer component parts may be required. For example, the return manifold may be integral to the cold plate.

As such, in the present disclosure the manifold assembly 100 comprises a first manifold portion 102 and a second manifold portion 104, which are coupled together in use as shown in FIG. 3. Each manifold portion 102, 104 is fluidly coupled to both the inlet pipe 108 and the outlet pipe 106. The manifold portions 102, 104 are shown in an exploded or unassembled form in FIGS. 4 to 6.

It is important for the first manifold portion 102 and the second manifold portion 104 to be coupled correctly to prevent leakage and ensure efficient cooling of the cold plates 202, 204. It is also important for the first manifold portion and the second manifold portion to be coupled correctly to ensure that the cold plates 202, 204 coupled thereto are properly aligned and positioned. As mentioned above, if the cold plates 202, 204 are misaligned, for example if the distance d is incorrect or is not uniform across the plate, then the cold plates 202, 204 may not mate correctly with the btb connectors 250 and/or there may be non-uniform thermal interface compression. In summary, the cooling system 200 may not operate optimally.

If the first manifold portion and the second manifold portion are correctly aligned and positioned relative to each other, then this can ensure that the cold plates coupled thereto are correctly aligned and positioned relative to each other. For this reason, in the present disclosure the first manifold portion and the second manifold portion are each provided with at least one positioning member, as shown in FIGS. 4 to 6.

Figure 4:
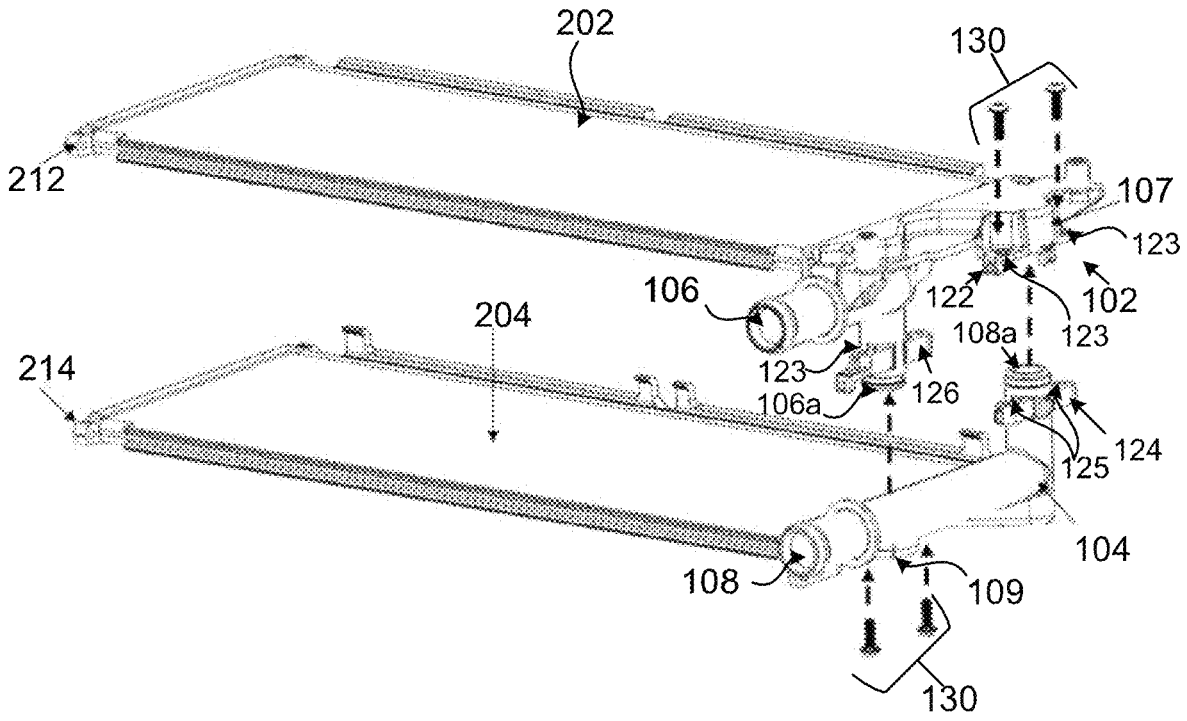
FIG. 4 shows the cooling system of FIG. 3 in a partially assembled form.
Figure 5:
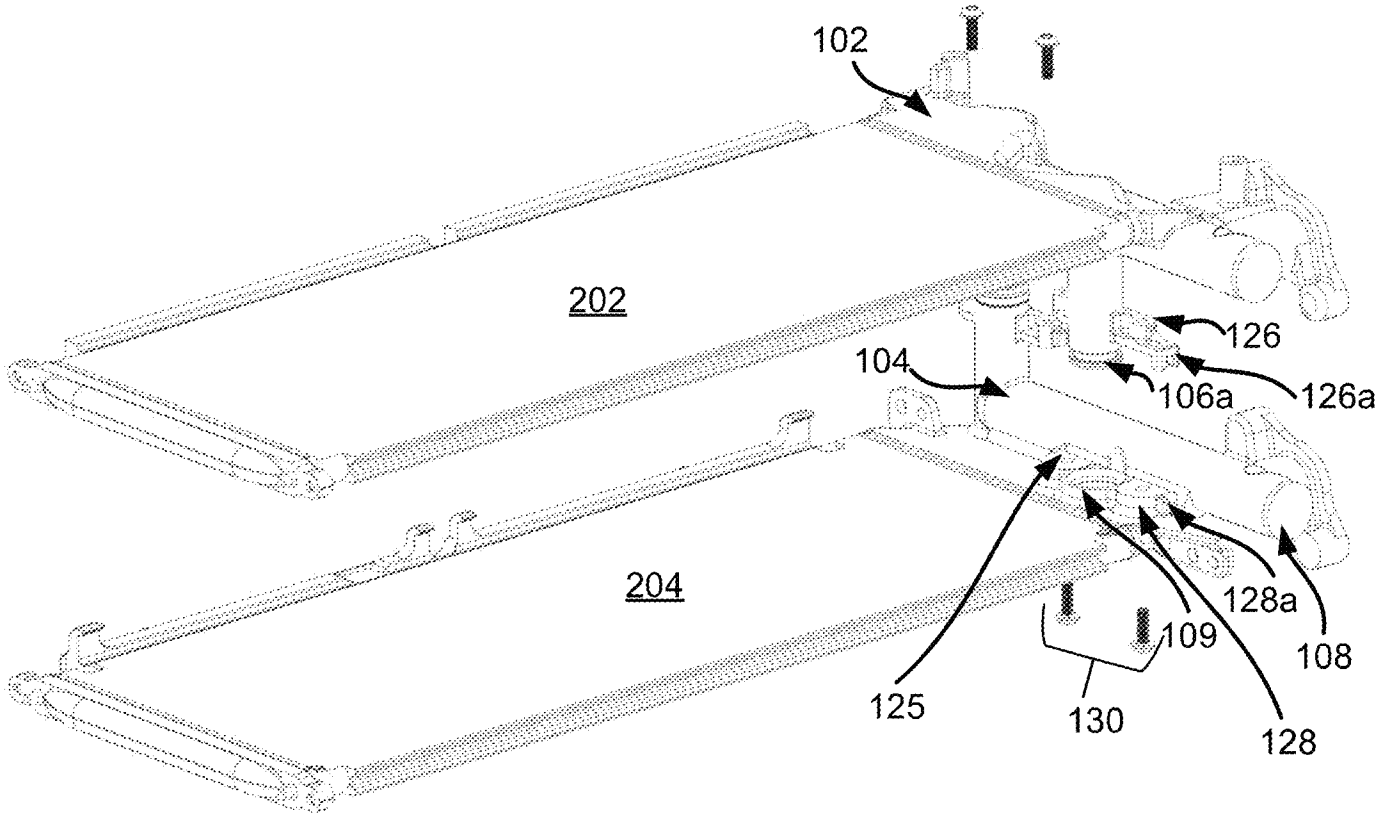
FIG. 5 shows another side perspective view of a cooling system according to an embodiment of this disclosure in a partially assembled form.
Figure 6:
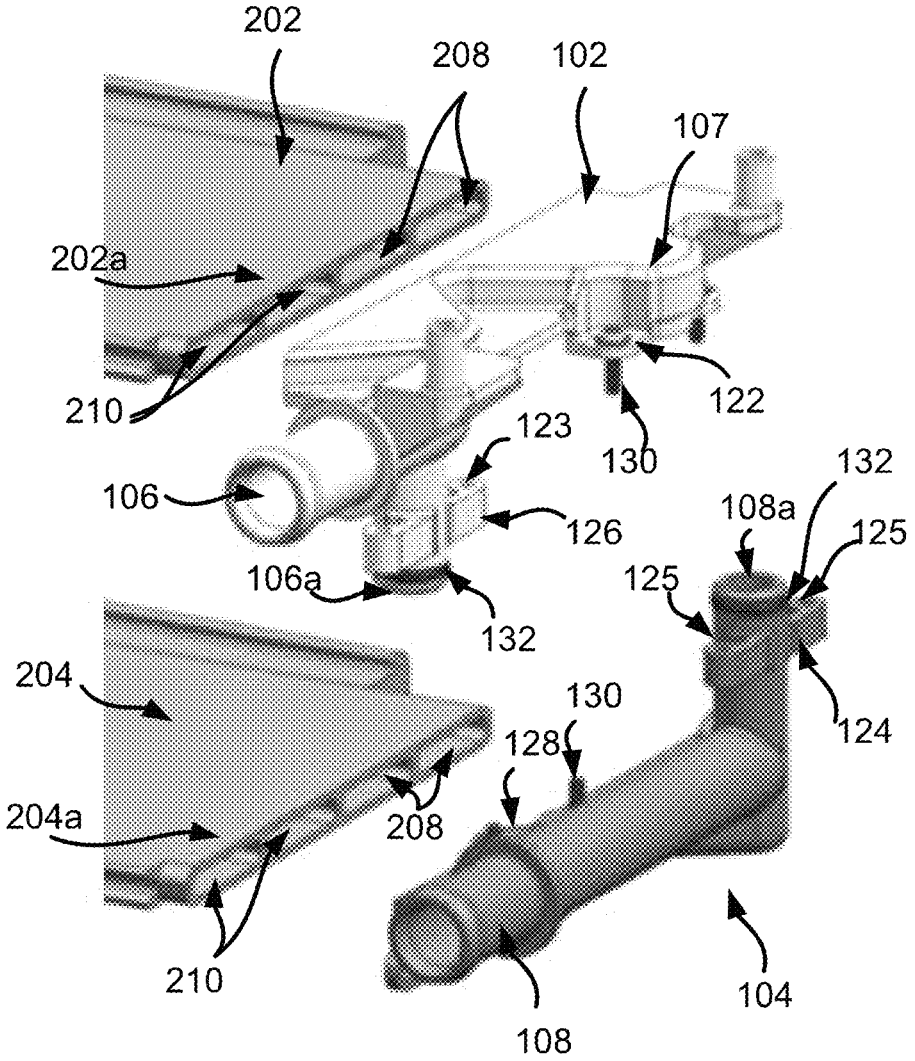
FIG. 6 shows a portion of the cooling system of FIG. 3 with the cold plates de-coupled from the manifold assembly.

FIGS. 4 and 5 are side perspective views of a cooling system 200 before the first manifold portion 102 has been coupled to the second manifold portion 104. In some embodiments, the first manifold portion 102 may be referred to as the outlet manifold and the second manifold portion 104 may be referred to as the inlet manifold, or vice versa.

In this embodiment, the first manifold portion 102 comprises a first pipe 106. The first pipe 106 is integral to the first manifold portion 102, such that the first pipe 106 and the first manifold portion 102 form a unitary structure. The first pipe 106 may be an outlet pipe for outputting returned coolant fluid.

In this embodiment, the second manifold portion 104 comprises a second pipe 108. The second pipe 108 is integral to the second manifold portion 104, such that the second pipe 108 and the second manifold portion 104 form a unitary structure. The second pipe 108 may be an inlet pipe for receiving input coolant fluid. As such, in this embodiment both pipes 106, 108 are formed integrally with the manifold portions 102, 104, and as such are not removable.

As shown in FIG. 4, the first manifold portion 102 comprises two positioning members 122 and 126. In other embodiments, only a single positioning member may be provided. One of the positioning members 126 is provided proximate an end 106*a* of the outlet (or first) pipe 106. The other one of the positioning members 122 is provided proximate a second receiving portion 107 in the first manifold portion. The second receiving portion 107 is an opening or aperture in the first manifold portion 102.

The second manifold portion 104 also comprises two positioning members, 124, 128. Although only one positioning member 124 is visible in FIG. 4, the other positioning member 128 is shown in FIG. 5. Again, in other embodiments, only a single positioning member may be provided. Positioning member 124 is provided proximate an end 108*a* of the inlet (or second) pipe 108. The other positioning member 128 is equivalent to the positioning member 122 and is provided proximate a first receiving portion 109 in the second manifold portion. The first receiving portion 109 is an opening or aperture in the second manifold portion 104.

To assemble the manifold 100 the first manifold portion 102 is coupled to the second manifold portion 104 by inserting the end 106*a* of the outlet pipe into the first receiving portion 109 in the second manifold portion. Concurrently, the end 108*a* of the inlet pipe is inserted into the second receiving portion 107 in the first manifold portion. This is represented by the broken lines in FIG. 4. Thus, two internal interfaces are formed between the first and second manifold portions.

To position and orientate the first manifold portion 102 and the second manifold portion 104 correctly relative to one another, the first and second manifold portions 102, 104 are adjusted until the positioning members on the first manifold portion engage the positioning members on the second manifold portion.

In this embodiment, each positioning member 122, 124, 126, 128 comprises a pair of projections or wings extending on either side of the respective pipe or receiving portion. Each projection or wing comprises an aperture 123, 125. In some embodiments, each positioning member may have the same shape or configuration. Alternatively, as in FIG. 4, the complementary positioning members may have differing shapes. It will be appreciated that the positioning members are not limited to the configurations shown.

In the embodiment shown in FIG. 5, the first positioning member 126 comprises an additional portion 126*a* having a recess configured to receive a protrusion 128*a* on the second positioning member 128.

The apertures 123 are aligned with the apertures 125 when the first and second manifold portions 102, 104 are coupled correctly. The apertures 123, 125 are for receiving a respective fastener 130 therethrough to secure or clamp the two manifold portions together in the correct coupling position, as shown by the broken lines in FIG. 4. Thus, in some embodiments, each pair of fasteners 130 may be inserted in opposite directions.

In this embodiment, the fasteners 130 are screws and the apertures 123, 125 are through-holes. In other embodiments, one or more alternative fasteners may be provided, such as a nut and bolt, or the positioning members may be welded or otherwise secured together. Similarly, in other embodiments only one pair of apertures may be through-holes, for example apertures 125 in positioning member 124 may be provided in a threaded screw boss, but the apertures 125 may not extend completely through the body of the positioning member 124.

FIG. 6 shows an alternative view of the cooling system 200 before the manifold portions 102, 104 have been coupled to the respective cold plate 202, 204. In this embodiment, each cold plate 202, 204 comprises two input passages 208 and two output passages 210. It will be appreciated that passages 208 could alternatively be output passages, and passages 210 could be input passages, depending on the particular fluid flow arrangement. Each passage extends longitudinally through the body of the cold plate and provides a flow path for coolant fluid to flow through the cold plate. It will be appreciated that any number of input and output passages may be provided, and that the present disclosure is not limited to the cold plate shown in FIG. 6.

The first return manifold 212 (see FIG. 3) couples the input passages 208 to the output passages 210 on the first cold plate 202. The second manifold 214 couples the input passages 208 to the output passages 210 on the second cold plate 204. Thus, the return manifolds 212, 214 complete the fluid flow passage from the input passages to the output passages 210. In some embodiments, the return manifolds may be integral to (or integrated with) the cold plates.

The first manifold portion 102 comprises an opening for receiving the end 202*a* of the cold plate. The first manifold portion 102 also comprises at least one inlet channel (not shown) fluidly connected to the second receiving portion 107, which in use is coupled to the inlet pipe 108 of the second manifold portion. The at least one inlet channel is arranged to interface with the input passages 208 when the first manifold portion 102 is coupled to the cold plate 202.

The first manifold portion 102 comprises at least one outlet channel (not shown) fluidly connected to the outlet pipe 106. The at least one outlet channel is arranged to interface with the output passages 210 when the first manifold portion 102 is coupled to the cold plate 202.

Similarly, the second manifold portion 104 comprises an opening for receiving the end 204*a* of the cold plate. The second manifold portion 104 comprises at least one inlet channel (not shown) fluidly connected to the inlet pipe 108. The at least one inlet channel is arranged to interface with the input passages 208 when the second manifold portion 104 is coupled to the cold plate 204.

The second manifold portion 104 comprises at least one outlet channel (not shown) fluidly connected to the first receiving portion 109 (see FIG. 4), which in use is coupled to the outlet pipe 106 of the first manifold portion. The at least one outlet channel is arranged to interface with the output passages 210 when the second manifold portion 104 is coupled to the cold plate 204.

In this embodiment, the first manifold portion 102, the outlet pipe 106 and the positioning members 122, 126 are formed as a single unitary structure. Thus, the positioning members 122, 126 are integral to the first manifold portion 102 and are not removable. Similarly, the second manifold portion 104, the inlet pipe 108 and the two positioning members 124, 128 are formed as a single unitary structure. Thus, the positioning members 124, 128 are integral to the second manifold portion 104 and are not removable. This ensures that the positioning members are provided at a fixed positions. This can also provide a more compact and space-efficient manifold assembly.

In some embodiments, the two unitary structures are formed of aluminum, as this can allow for accurate manufacture of the components within tight tolerances. The unitary structures may be die cast. However, it will be appreciated that other manufacturing processes and/or materials may be used depending on the particular system requirements.

As shown in FIGS. 4 and 5, the end 106*a* of the outlet pipe 106 and the end 108*a* of the inlet pipe 108 each comprise an annular groove for receiving or seating a respective O-ring 132. When the first and second manifold portions 102, 104 are coupled together as shown in FIGS. 3 and 6, the O-rings 132 are provided at the internal interface between the first manifold portion 102 and the second manifold portion 104. The positioning members 122, 124, 126, 128 are positioned to ensure that, when they are aligned, the O-rings 132 are located at the correct positions and insertion depths.

Figure 7:
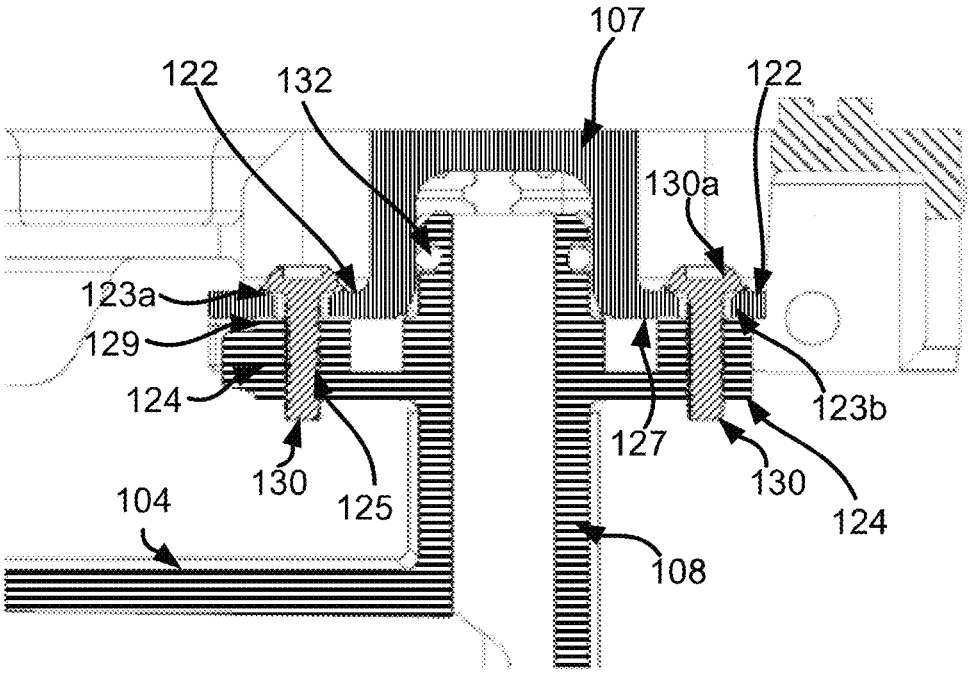
FIG. 7 shows a close up of an interface between the first and second manifold portions.

FIG. 7 shows a close-up of the interface between the inlet pipe 108 of the second manifold portion 104 and the second receiving portion 107 in the first manifold portion 102. The first and second positioning members 122, 124 are clamped together such that the flat engagement surfaces 127, 129 of the positioning members are held in contact with each other. When clamped, the flat engagement surfaces 127, 129 are parallel to the cold plate 202. It is important for the positioning members 122, 124 to each have a flat engagement surface, as this provides a flat contact surface between the positioning members. To clamp the engagement surfaces 127,129 together, the first and second manifold portions are positioned such that the apertures 125 in the positioning member 122 are aligned with the apertures 123 to receive a fastener 130 therethrough. This locates the cold plates 202, 204 at the correct position and orientation.

In this embodiment, the apertures 123 provided at either side of the second receiving portion 107 comprise a beveled portion 123*a* and a straight or vertical portion 123*b*. The straight portion 123*b* is sized to allow passage of the body of the screw 130 therethrough, but not the screw head 130*a*.

In FIG. 7, the O-ring 132 is positioned such that when the positioning members 122, 124 are engaged and aligned, the O-ring provides a seal between the two pipes 107, 108 which prevents leakage of coolant fluid at the interface.

Figure 8:
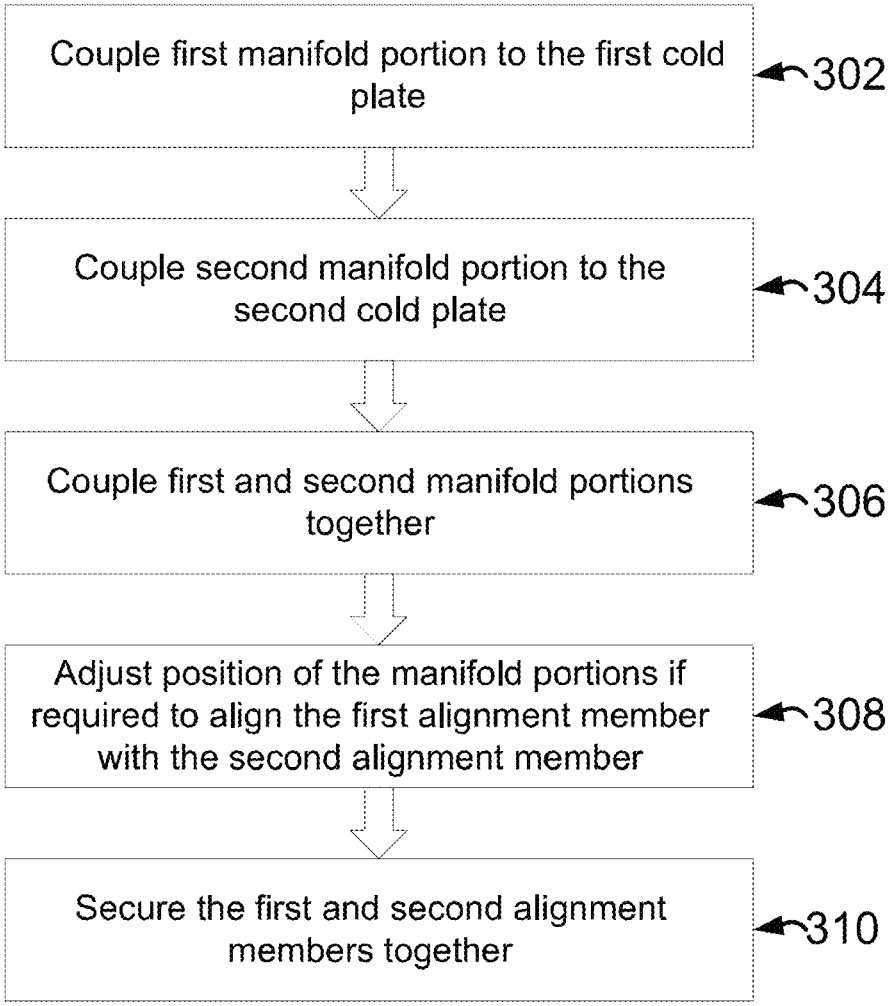
FIG. 8 is a flow chart describing a method of assembling a cooling system according to an embodiment of this disclosure.

A method of assembling the cooling system shown in FIGS. 2 to 6 is described in the flow chart shown in FIG. 8. In this embodiment, at step 302 the first manifold portion is coupled to the first cold plate. At step 304, the second manifold portion is coupled to the second cold plate. It will be appreciated that steps 302 and 304 can occur at the same time. It will also be appreciated that either of manifold portions 102, 104 can be considered to be the first manifold portion, and similarly either of the cold plates 202, 204 can be considered to be the first cold plate. To couple the cold plate 202, 204 to the respective manifold portion 102, 104 an end of the cold plate may be inserted into an opening in the manifold portion 102, 104. The cold plate 202, 204 may be welded to the respective manifold portion 102, 104, to secure the two components together and provide a seal that prevents leakage of coolant fluid.

At step 306 the method comprises coupling the first manifold portion 102 to the second manifold portion 104. As described above, in some embodiments this may comprise inserting a pipe of the first or second manifold portion into a complementary receiving portion of the second or first manifold portion. In the embodiments shown in FIGS. 3 to 6, each manifold portion 102, 104 has a pipe and a receiving portion and step 306 comprises coupling the pipe of each manifold portion to the receiving portion of the other manifold portion. However, the specific manifold configuration depends on the particular requirements of the cooling system and the present disclosure is not limited to this particular embodiment.

At step 308, the position of the first and/or second manifold portions 102, 104 is adjusted if required to ensure that the first positioning member engages the second positioning member, to ensure that the cold plates are at the correct position and orientation. A portion of the first positioning member may be aligned with a portion of the second positioning member when the manifold portions are in the correct position.

If each manifold portion comprises a plurality of positioning members, then each of the first positioning members should be aligned with the corresponding second positioning member.

Optionally, at step 310 the first and second positioning members are clamped or secured together to fix the manifold assembly in the desired position, thereby preventing any subsequent misalignment of the components. Any suitable type of securing may be used, such as welding, brazing, screws, bolts, or other fastening means connecting the positioning members together.

In some embodiments, step 309 comprises aligning the apertures of the first and second positioning members such that at step 310 a screw or other fastener can be inserted into or through the apertures.

Accordingly, there has been described a coolant fluid manifold assembly for coupling to a plurality of cold plates, wherein the manifold assembly comprises a first manifold portion comprising a first positioning member, a second manifold portion comprising a second positioning member, wherein the second manifold portion is configured to couple to the first manifold portion and the second positioning member is configured to be aligned with the first positioning member when the first and second manifold portions are correctly coupled.

Although particular embodiments of this disclosure have been described, it will be appreciated that many modifications/additions and/or substitutions may be made within the scope of the claims.

The term non-transitory computer-readable medium does not encompass transitory electrical or electromagnetic signals propagating through a medium (such as on a carrier wave). Non-limiting examples of a non-transitory computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The term "set" generally means a grouping of one or more elements. The elements of a set do not necessarily need to have any characteristics in common or otherwise belong together. The phrase "at least one of A, B, and C" should be construed to mean a logical (A OR B OR C), using a non-exclusive logical OR, and should not be construed to mean "at least one of A, at least one of B, and at least one of C." The phrase "at least one of A, B, or C" should be construed to mean a logical (A OR B OR C), using a non-exclusive logical OR.

The invention claimed is:

1. A coolant fluid manifold assembly comprising:

a first manifold portion configured for coupling to a first cold plate, the first manifold portion including a first pipe and a first positioning member adjacent to an end of the first pipe; and a second manifold portion configured for coupling to a second cold plate, the second manifold portion including a first receiving portion and a second positioning member adjacent to the first receiving portion, wherein the second manifold portion is configured to couple to the first manifold portion by receiving the end of the first pipe inserted into the first receiving portion, wherein the second positioning member is configured to engage the first positioning member to correctly position the first and second manifold portions, and wherein the first manifold portion and the second manifold portion are spaced apart to define a separation distance between the first cold plate and the second cold plate respectively, the separation distance configured to accommodate at least one electronic device therebetween.

2. The manifold assembly of claim 1 wherein a portion of the first positioning member is configured to be aligned with a portion of the second positioning member.

3. The manifold assembly of claim 1 wherein:

each positioning member includes a respective aperture for receiving a fastener, and the aperture of the first positioning member is configured to be aligned with the aperture of the second positioning member to correctly position the first and second manifold portions.

4. The manifold assembly of claim 1 wherein each positioning member includes a respective flat engagement surface.

5. The manifold assembly of claim 1 wherein the first positioning member is integral to the first manifold portion.

6. The manifold assembly of claim 1 wherein the second positioning member is integral to the second manifold portion.

7. The manifold assembly of claim 1 wherein the end of the first pipe includes an annular groove for receiving an O-ring.

8. The manifold assembly of claim 1 wherein:

the first positioning member includes a pair of projections extending either side of the first pipe; and the second positioning member includes a pair of projections extending either side of the first receiving portion.

9. The manifold assembly of claim 8 wherein:

each projection of the first positioning member includes an aperture for receiving a respective fastener, each projection of the second positioning member includes an aperture for receiving a respective fastener, and the apertures of the first positioning member are configured to be aligned with the apertures of the second positioning member to correctly position the first and second manifold portions.

10. The manifold assembly of claim 1 wherein:

the first manifold portion includes a second receiving portion;

the second manifold portion includes a second pipe, wherein an end of the second pipe is configured to be inserted into the second receiving portion; and each pipe and each receiving portion includes a respective positioning member.

11. A cooling system comprising:

the manifold assembly of claim 1;

a first cold plate coupled to the first manifold portion; and a second cold plate coupled to the second manifold portion, wherein the separation distance is configured to accommodate the at least one electronic device to be in contact with at least one of the first cold plate or the second cold plate.

12. The cooling system of claim 11 wherein:

each positioning member includes a flat engagement surface; and the engagement surface of the first positioning member is clamped to the engagement surface of the second positioning member such that the engagement surfaces are parallel to the first and second cold plates.

13. A method of assembling a cooling system, the method comprising:

coupling a first manifold portion to a first cold plate, wherein the first manifold portion includes a first pipe and a first positioning member adjacent to an end of the first pipe;

coupling a second manifold portion to a second cold plate, wherein the second manifold portion includes a first receiving portion and a second positioning member adjacent to the first receiving portion;

arranging at least one electronic device to be in contact with at least one of the first cold plate or the second cold plate; and coupling the second manifold portion to the first manifold portion by receiving the end of the first pipe inserted into the first receiving portion and such that the first positioning member engages the second positioning member to locate the first and second cold plates at correct positions and orientations, wherein the first cold plate and the second cold plate are spaced apart by a separation distance configured to accommodate the at least one electronic device therebetween.

14. The method of claim 13 wherein:

each positioning member includes a respective aperture for receiving a fastener, and the method further comprises:

aligning the aperture of the first positioning member with the aperture of the second positioning member; and clamping the first and second manifold portions together by inserting a fastener through the apertures.

15. The method of claim 13 wherein:

the end of the first pipe includes an annular groove;

the method includes seating an O-ring in the annular groove; and inserting the end of the first pipe into the first receiving portion results in the O-ring being located at an interface between the first pipe and the first receiving portion.

* * * * *